United States Patent [19]

Bequette

[11] 4,450,121

[45] May 22, 1984

[54] APPARATUS AND METHOD FOR BRIDGE DECK CONSTRUCTION

[76] Inventor: Noah L. Bequette, Route 1, Box 663, Cedar Hill, Mo. 63016

[21] Appl. No.: 354,158

[22] Filed: Mar. 5, 1982

[51] Int. Cl.[3] ..... E04B 1/16

[52] U.S. Cl. ..... 264/31; 248/240.3; 249/28; 249/48

[58] Field of Search ..... 248/240, 240.2, 240.3, 248/239, 241, 354 S, 669, 656, 235, 238; 264/31, 32, 33; 249/28, 48, 19, 1; 182/82; 52/584, 637, 638, 74; 24/230.5 TP, 241 SL, 248 E, 251, 155 R

[56] References Cited

U.S. PATENT DOCUMENTS

| | | | |
|---|---|---|---|
| 1,159,956 | 11/1915 | Klepinger | 248/240.3 |
| 1,334,677 | 3/1920 | Reichert | 249/48 |
| 1,339,482 | 5/1920 | Sederburg | 248/240.3 |
| 1,450,286 | 4/1923 | Graff | 248/240.3 |
| 1,608,036 | 11/1926 | Robinson | 248/240.3 |
| 1,889,452 | 11/1932 | Porter | 248/240.3 |
| 2,831,231 | 4/1958 | Toensing | 249/48 |
| 3,119,590 | 1/1964 | Ericksson | 248/240.3 |
| 3,120,941 | 2/1964 | Cameron | 248/354 S |
| 3,165,288 | 1/1965 | Jackson | 248/235 |
| 3,172,634 | 3/1965 | Squire | 248/354 S |
| 3,329,747 | 7/1967 | Veach | 264/31 |
| 3,373,879 | 3/1968 | Verini | 248/656 |
| 3,880,394 | 4/1975 | Wisecarver | 248/354 S |
| 3,920,220 | 11/1975 | Elias | 248/354 S |
| 4,153,229 | 5/1979 | Bequette | 248/240.3 |

FOREIGN PATENT DOCUMENTS

| | | | |
|---|---|---|---|
| 252465 | 6/1912 | Fed. Rep. of Germany . | |
| 450495 | 3/1913 | France | 24/155 |

*Primary Examiner*—Jay H. Woo

*Attorney, Agent, or Firm*—John D. Pope, III; Edward R. Weber

[57] ABSTRACT

This invention is a reusable apparatus and method of using the apparatus for supporting decking and forms used in constructing a bridge, roadway or other elevated surface. The apparatus is easily attached to the load bearing beams and is readily adjustable to proper grade without the necessity of shims.

19 Claims, 6 Drawing Figures

FIG. 3
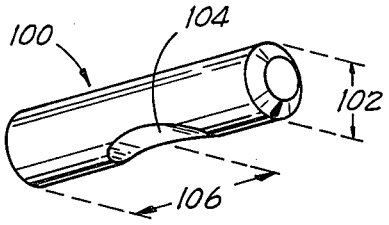
FIG. 4
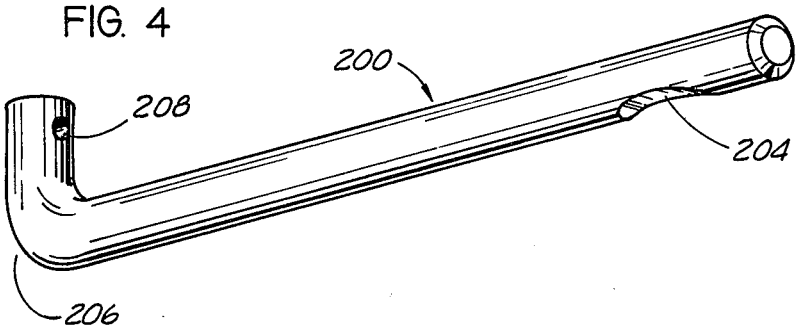
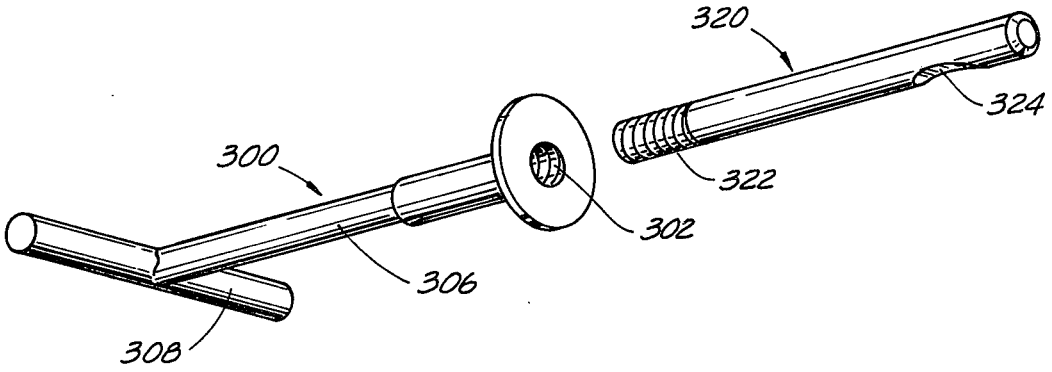
FIG. 5

APPARATUS AND METHOD FOR BRIDGE DECK CONSTRUCTION

This invention relates to a reusable apparatus and method for using the apparatus for supporting deckings, forms or other structures useful in constructing a bridge, roadway or other elevated surface. More specifically, this invention relates to an adjustable apparatus particularly suitable for supporting concrete forms used in the construction of bridges, viaducts and other load-bearing structures which utilize precast concrete or steel beams as the principle load-bearing members.

The current practice in the bridge building industry is to erect the load bearing members and then to construct scaffolding to support decking and forms suitable for forming the roadway. Most commonly the roadway will be reinforced concrete. Reinforced concrete has substantial weight and will yield an unacceptable roadway if not properly supported. The construction of scaffolding to support the forms has previously presented numerous difficulties, each bridge presenting its own particular set of problems. As a result each installation must be specially designed. Such custom work requires special materials, tools and skills for the proper erection and support of the concrete forms. In many installations, large quantities of lumber are employed requiring custom fitting and much labor for the erection. In addition, much of the work must be done at significant distances from the ground, thus creating a safety hazard for the workers. Because of the nature of the operation, a high percentage of the lumber used in forming is not reusable and this increases the cost of the installation.

Many attempts have been made over the years to design a support apparatus which would have a more general applicability. None of the proposed systems have been totally acceptable. Either the proposed system lacked adaptability or it was quite complex, frequently involving components passing over the top of the load-bearing beam and thus being within the area encompassed by the poured concrete roadway. Such components are necessarily single use pieces, as they remain behind in the roadway.

One object of the instant invention is to provide a support structure which does not involve special components which are, by their nature, single use items. Another object of the invention is to provide a structure which may be readily attached to the support beams prior to their installation at the elevated location and thus reduce the amount of labor which must be performed after the support beams are installed. Yet another object of the invention is to provide a structure which is easily adjustable to proper grade and provides a mechanism for establishing a crown in the roadway, a soffit around the beam flange and other custom features. To provide these features using prior mechanisms has required extensive special forming and shimming. Still another object of the invention is to provide an apparatus which may be easily removed from the load-bearing beams after the roadway has been constructed, but which can be reinstalled at a subsequent time should repair work or other activity make such reinstallation desirable. These objects and features will be in part apparent and in part pointed out hereinafter.

The invention accordingly comprises the construction hereinafter described, the scope of the invention being indicated in the following claims.

In the accompanying drawings in which one of various possible embodiments of the invention is illustrated, FIG. 1 is a perspective view showing one of the various possible embodiments of the invention;

FIG. 3 is a perspective view of a pin suitable for welding to a steel beam for attaching the invention to said beam;

FIG. 4 is a perspective view of a similar pin designed to be installed in a concrete beam or other cast support structure;

FIG. 5 is a perspective view of a threaded receptacle designed to be installed in a concrete beam or other cast support structure which receptacle is suitable for removable installation of a pin for attaching the instant invention.

Figures 1, 2:
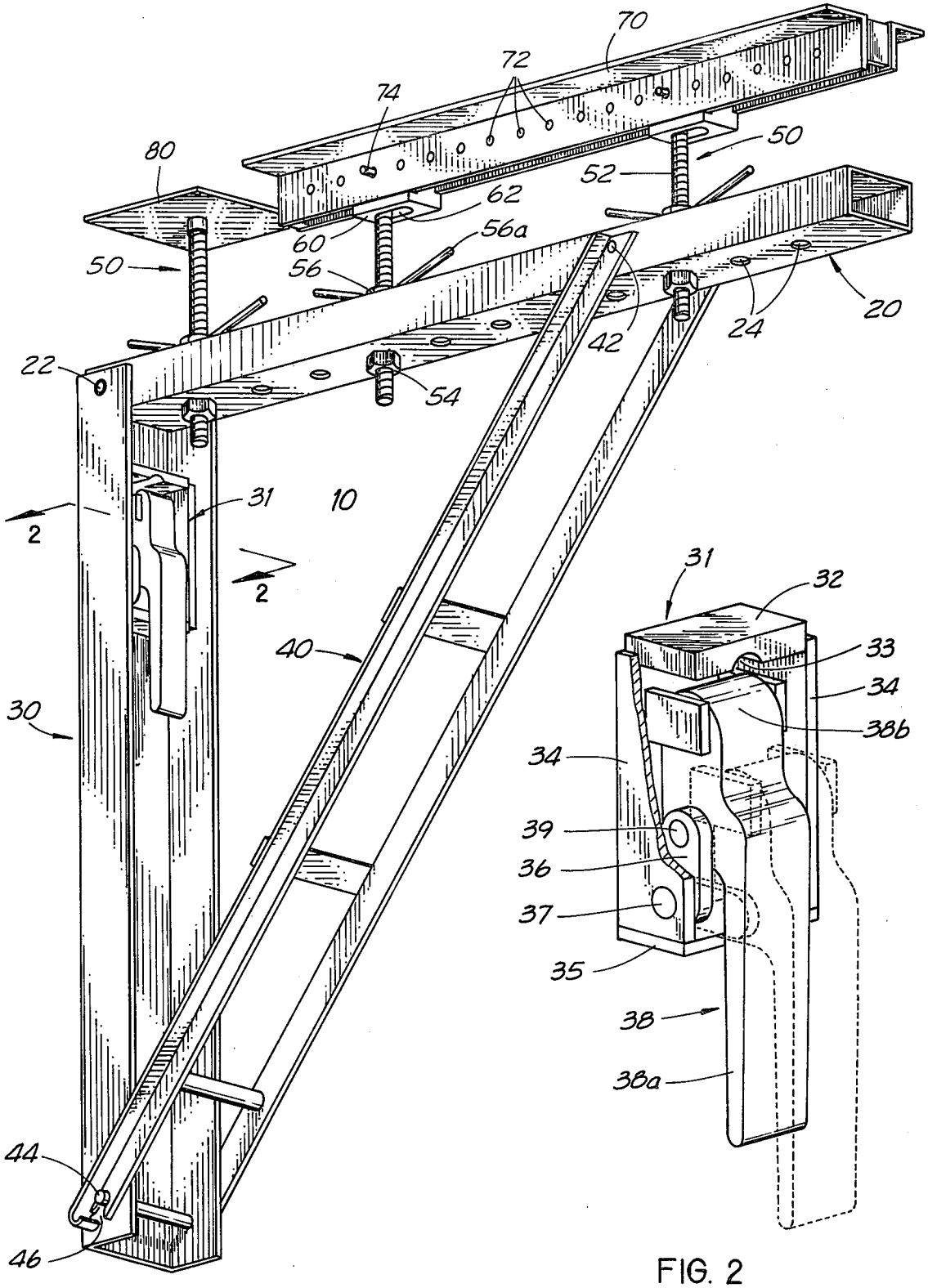
FIG. 2 is a perspective view of the toggle lock means identified by line 2—2 of FIG. 1.

In FIG. 1, a support apparatus, generally designated as 10, consists of a first elongated member 20, which elongated member is attached at one end through pivotal connection 22, to a second elongated member 30. A third elongated member 40 connects separated points on members 20 and 30 so as to provide a rigidly braced structure. In the embodiment shown in in FIG. 1, member 40 is connected to member 20 by pivot 42. It is further connected to member 30 by engaging pin 44 mounted on member 30 in slot 46 at the unpivoted end of member 40. It is thus clear that member 40 may be disengaged from member 30 and the structure may then be collapsed for storage, transportation, etc.. When member 40 is engaged with member 30, a rigidly braced structure capable of bearing great loads is formed. As will be obvious to one skilled in the art, such conventional details as materials of construction, intermediate bracing and dimensions may be varied according to the loads which it is anticipated the structure will be required to support.

Member 30 is provided with a means for engaging the support structure upon which the apparatus will be mounted. In the embodiment illustrated, this means comprises a toggle lock means generally designated as 31. This means is shown in greater detail in FIG 2. The toggle lock means comprises a rectangular box attached to member 30 near pivotal connection 22. The top portion of this rectangular box consists of bearing block 32, which has a concave depression 33 in its lower surface designed for mating with the cylindrical surface of a steel pin installed on the load-bearing beam. Member 30 has a hole, slot or other cutaway (not shown) adjacent to depression 33 which permits the steel pin to pass through and engage said depression 33. Toggle lock mechanism 31 further comprises side plates 34, attached to the sides of bearing block 32 and bottom plate 35 which is attached across the lower ends of side plates 34 to form the rectangular structure. Toggle plates 36 are pivotally connected to side plates 34 with pivot pins 37. Toggle plates 36 are likewise pivotally connected to locking member 38 with pivot pin 39. Locking member 38 consists of a handle portion **38*a* and a cam portion 38*b*. Cam portion 38*b* is shaped to mate with a concave depression in the aforementioned steel pin when the steel pin is engaged in depression 33. FIG. 3 illustrates one version of such a steel pin. In FIG. 3, steel pin 100 is cylindrical and is intended to be welded to a steel beam. The diameter 102 of pin 100 is the same as the diameter of the concave depression 33 in upper bearing block 32. Steel pin 100 also has a concave depression 104 in its lower surface. Distance 106, the distance from the back of pin 100 to the center line of depression 104, is such that when apparatus 10 is mounted upon pin 100, concave depression 104 falls under upper bearing block 32 and is positioned to be engaged by cam 38*b* when locking member 38 is in its closed position. As will be understood, apparatus 10 is extremely simple to install. Steel pins, such as pin 100, are welded or otherwise attached to a load-bearing member. Apparatus 10 is then supported on the steel pin by means of upper bearing block 32. The apparatus is locked into position by engaging cam 38*b* with concave recess 104 and moving locking member handle 38*a* from an open to a closed position. When in the closed position, downward forces on elongated member 20 produce vectors which pull upper cam 38*b* into even tighter engagement with depression 104 and thus produce a self-locking feature which prevents accidental disengagement of the toggle lock mechanism 31 and pin 100. The toggle lock means described is only one of many possible means of attaching apparatus 10** to the steel pin and thus to the load bearing structure.

In one variation of the toggle lock mechanism, toggle plates 36 are pivotally connected to a support block instead of being pivotally connected to side plates 34 of the toggle lock mechanism. The support block is attached to bottom plate 35 by means of a threaded member. Rotating the threaded member shifts the relative positions of the support block, toggle plates 36 and locking member 38 with relation to bearing block 32. This permits adjustment of the toggle lock to accommodate variations in pin diameter and/or position of the concave depression in the steel pin.

Elongated member 20 is further provided with a plurality of holes 24 through which one or more positioning means 50 pass. Each of the positioning means 50 comprises a male threaded member 52 and two female threaded members 54 and 56. If desired, one or both of members 54 and 56 may have wings or handles **56*a* attached thereto to facilitate rotation of the member and the resultant adjustment of the position of structure 50 with respect to elongated member 20. In a preferred embodiment, the uppermost end of member 52 has opposing faces milled to produce parallel flats (not shown) which engage mounting blocks 60. Each mounting block 60 has an internal slot 62 which engages the parallel flats of member 52 and prevents rotation of the member 52 about its longitudinal axis. Slot 62, however, permits angular variation of mounting block 60 with respect to threaded member 52 within the plane defined by members 20, 30 and 40. Mounting block 60 engages fourth elongated member 70 and firmly supports member 70 in spaced relationship to elongated member 20. In the embodiment illustrated, mounting block 60 may be positioned laterally at various locations along member 70. A plurality of holes 72 in member 70 are provided so that once the correct lateral relationship between member 20 and member 70 has been established, further lateral movement may be prevented by passing a locking pin 74 through one of said holes 72 and a corresponding hole (not shown) in mounting block 60. If desired, a hole may also be provided in member 52 to be engaged by the same locking pin, thus uniting member 52, block 60 and elongated member 70** into a single structure.

As will be readily apparent to one skilled in the art, the described positioning structure readily permits variation of both the lateral and angular relationship of members 70 and 20. This ease of adjustment readily permits adjustment of the upper surface of member 70 without necessity of shims. This adjustment readily facilitates adjustment to grade, the provision of crown or other desired adjustment in the position of roadway forms.

In the embodiment illustrated, an additional member 80 is provided. This member has its own positioning member 50, which is of the same construction as previously described. Member 80 provides support for a second level of form as is frequently desired to permit formation of a concrete soffit around the flange of the load-bearing beam. If desired, member 80 may also be of an elongated nature similar to member 70 and may be supported by more than one positioning member 50.

As can be readily understood, the apparatus 10 of the invention provides an extremely versatile erection apparatus, which can be adjusted to meet a varying number of erection conditions without the necessity of special additional components. If desired, internal gussets, braces or other supports may be provided in any of the members to permit them to handle increased loads. Washers or other load spreading devices may also be utilized.

FIGS. 4 and 5 depict additional variations of the pins for mounting apparatus 10 to a beam or other load-bearing structure. In FIG. 4, a pin is illustrated for installation in a concrete load-bearing member. Pin 200 has concave depression 204 of a similar dimension and design as depression 104 in pin 100. Pin 200 is somewhat elongated and has a bend 206 at one end. Bend 206 engages the concrete structure in which pin 200 is imbedded and prevents the pin from being pulled loose when it is supporting apparatus 10. In the embodiment illustrated, pin 200 is provided with a hole 208, which is utilized for affixing the pin to the inside of a concrete form prior to casting the load-bearing structure.

FIG. 5 depicts another type of pin 300 for installation in a concrete structure. Pin 300 has a threaded receptacle 302 on one end of a bar structure 306, which bar structure is imbedded in the concrete load-bearing structure. Bar structure 306 is provided with a cross member 308 in spaced relationship to the receptacle 302. Cross member 308 has the same function as angle 206 of pin 200, i.e., to prevent the structure from being pulled from the concrete structure. Threaded receptacle 302 engages threaded portion 322 of pin 320, which pin has a concave depression 324 having the same design and function as depression 104 in pin 100. As is readily apparent, this construction permits the receptacles to be cast into the load-bearing structure and the pin installed and removed as required.

Figure 6:
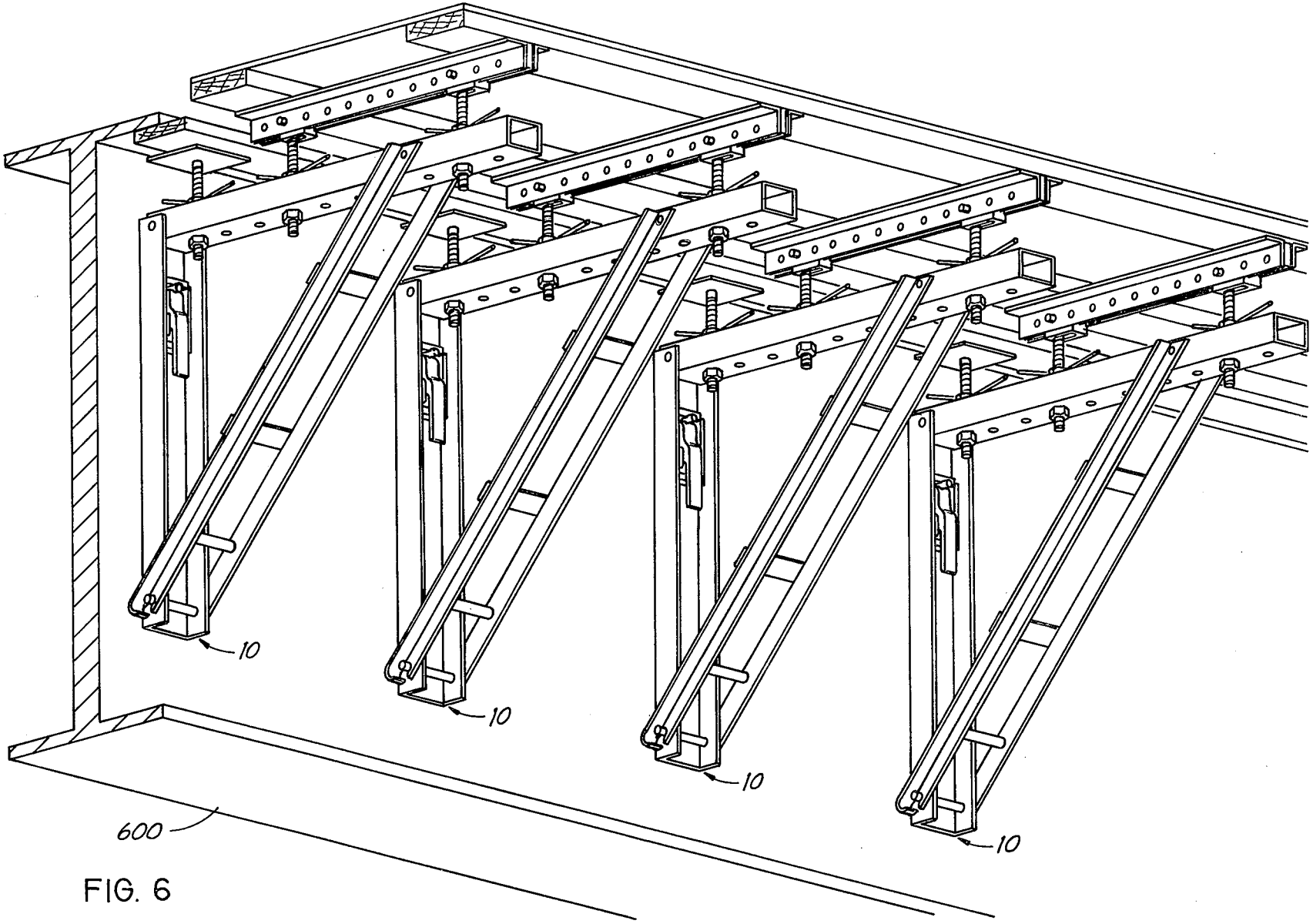
FIG. 6 is a perspective view of a steel beam showing several of the apparatus of the instant invention mounted thereon.

FIG. 6 depicts a steel beam structural support member 600 with a plurality of apparatus 10 mounted thereon. In a preferred method of using the invention, the apparatus 10 are installed on the beam prior to its erection at the elevated location of the bridge site. This results in a significant improvement in safety, since the workmen attaching apparatus 10 can work at ground level. After the required number of apparatus 10 are installed upon the beam, required decking and forms can also be installed and the whole structure can then be lifted and positioned at the elevated location. It is then a simple matter to adjust support members 70 and 80, utilizing positioning means 50, to establish the desired grade, to form and pour the roadway. Once the roadway has been constructed, removal of the forms and support apparatus 10 is very simple. This results in a considerable savings in clean-up and labor and a consequent reduction in overall construction costs. In addition, the mounting pins may be left in place, where they are readily available for reinstallation of apparatus 10, if such reinstallation is required at some later date for repair, maintenance or other activities in conjunction with the already erected bridge.

In view of the above, it will be seen that the several objects of the invention are achieved and other advantageous results obtained. As numerous variations can be made in the above constructions without departing from the scope of the invention, it is intended that all matter contained in the above description or shown in the accompanying drawings shall be interpreted as illustrative and not in a limiting sense.

What is claimed is:

1. A method of supporting decking or forms needed for the installation of roadways on bridges which comprises attaching a plurality of apparatus, each of which comprises a first elongated member, a second elongated member pivotally connected at one end to said first elongated member, third elongated member connecting separated points on said first and second elongated members so as to maintain said first and second elongated members in a fixed angular relationship, which third elongated member is pivotally connected to the first elongated member and detachably connected to the second elongated member; positioning means attached to said first elongated member, which positioning means supports a fourth elongated member, which fourth member is adapted to support the forms or decking and attaching means on said second elongated member for removably installing the apparatus on a substantially vertical surface of a support structure, which attaching means comprises toggle locking means particularly suited to engage a concave recess in a steel pin protruding from a substantially vertical surface of the support structure to a plurality of steel pins, each of which has a concave recess particularly designed to engage the toggle locking means of one of the apparatus, which pins are protruding from a substantially vertical surface of the support structure; and individually adjusting the fourth elongated member of each of said apparatus to support the forms or decking in the desired position.

2. The method of claim 1 wherein the positioning means consists of a plurality of threaded members which permit the position of the fourth elongated member to be varied with respect to the first elongated member.

3. The method of claim 2 wherein a mounting block is interposed between each threaded member and the corresponding fourth elongated member which mounting block substantially restricts the fourth elongated member so as to permit angular adjustment only in the plane containing the first, second, third and fourth elongated members.

4. A method of supporting decking or forms needed for the installation of roadways on bridges which comprises attaching a plurality of apparatus, each of which comprises a first elongated member, a second elongated member pivotally connected at one end to said first elongated member, third elongated member connecting separated points on said first and second elongated members so as to maintain said first and second elongated members in a fixed angular relationship, which third elongated member is pivotally connected to the first elongated member and detachably connected to the second elongated member; positioning means attached to said first elongated member, which positioning means supports a fourth elongated member, which fourth member is adapted to support the forms or decking and attaching means on said second elongated member for removably installing the apparatus on a substantially vertical surface of a support structure, which attaching means comprises toggle locking means particularly suited to engage a concave recess in a steel pin protruding from a substantially vertical surface of the support structure to a plurality of steel pins, each of which has a concave reference particularly designed to engage the toggle locking means of one of the apparatus, which pins are protruding from a substantially vertical surface of the support structure, and individually adjusting the fourth elongated member of each of said apparatus to support the form or decking in the desired position; wherein the plurality of apparatus are installed on the bridge support structure prior to erection of the bridge support structure at the bridge site, and the combined bridge support structure and apparatus are erected at the bridge site as a preassembled unit.

5. The method of claim 4 wherein the positioning means consists of a plurality of threaded members which permit the position of the fourth elongated member to be varied with respect to the first elongated member.

6. The method of claim 5 wherein a mounting block is interposed between each threaded member and the fourth elongated member which mounting block substantially restricts the fourth elongated member so as to permit angular adjustment only in the plane containing the first, second, third and fourth elongated members.

7. An apparatus particularly suitable for decking a bridge prior to installation of a roadway, comprising first elongated member, a second elongated member, connected pivotally at one end to said first elongated member, a third elongated member connecting separated points on said first and second elongated members so as to maintain said first and second elongated members in a fixed angular relationship, which third elongated member is pivotally connected to the first elongated member and detachably connected to the second elongated member; positioning means attached to said first elongated member, which positioning means supports a fourth elongated member, which fourth member is adapted to support the forms or decking and attaching means on said second elongated member for removably installing the apparatus on a substantially vertical surface of a support structure, which attaching means comprises toggle locking means particularly suited to engage a concave recess in a steel pin protruding from a substantially vertical surface of the support structure.

8. The apparatus of claim 7 wherein the steel pin is attached to the web of a steel beam portion of the support structure.

9. The apparatus of claim 8 wherein the steel pin is welded to the web of a steel beam portion of the support structure.

10. The apparatus of claim 7 wherein the steel pin is attached to a concrete portion of the support structure.

11. The apparatus of claim 10 wherein the steel pin is permanently installed in the concrete support structure at the time the concrete support structure is cast.

12. The apparatus of claim 7 wherein the steel pin is removably attached to a substantially vertical surface of the support structure.

13. The apparatus of claim 10 wherein the steel pin is removably attached to a mating device permanently installed in the concrete support structure at the time the concrete support structure is cast.

14. The apparatus of claim 7 wherein the positioning means consists of a plurality of threaded members which permit the position of the fourth elongated member to be varied with respect to the first elongated member.

15. The apparatus of claim 14 wherein a mounting block is interposed between each threaded member and the fourth elongated member which mounting block substantially restricts the fourth elongated member so as to permit angular adjustment only in the plane containing the first, second, third and fourth elongated members.

16. The apparatus of claims 7, 14 or 15 wherein the position of the fourth elongated member may be laterally adjusted with respect to the positioning means and the first elongated member.

17. The apparatus of claims 7, 14 or 15 wherein a fifth member and a second positioning means are provided which fifth member is adapted to support forms or decking in a different position than the forms or decking supported by the fourth elongated member.

18. The apparatus of claim 17 wherein the second positioning means consists of one or more threaded members which permit the position of the fifth member to be varied with respect to the fourth member and the first member.

19. The apparatus of claim 18 wherein a mounting block is interposed between each threaded member and the fifth member which mounting block substantially restricts the fifth member so as to permit angular adjustment only in the plane containing the first, second, third and fourth elongated member.

* * * * *